US005327601A

United States Patent [19]

Nakayama et al.

[11] Patent Number: 5,327,601

[45] Date of Patent: Jul. 12, 1994

[54] SPLIT ABRASIVE ROLL ATTACHMENT SYSTEM

[75] Inventors: Masashi Nakayama; Naohiro Nagafuchi, both of Kanagawa; Yoshihiro Fukase, Yamagata, all of Japan

[73] Assignee: Minnesota Mining and Manufacturing Company, St. Paul, Minn.

[21] Appl. No.: 27,083

[22] Filed: Mar. 5, 1993

[30] Foreign Application Priority Data

Mar. 9, 1992 [JP] Japan ..... 4-050573

[51] Int. Cl.[5] ..... B24B 41/00

[52] U.S. Cl. ..... 51/168; 51/206 P

[58] Field of Search ..... 51/168, 206 R, 206.5, 51/366

[56] References Cited

U.S. PATENT DOCUMENTS 2,145,980 2/1939 Hadwiger et al. ..... 51/194

FOREIGN PATENT DOCUMENTS 0395393 10/1990 European Pat. Off. ..... B24B 7/18
394137 4/1924 Fed. Rep. of Germany .
0461025 6/1928 Fed. Rep. of Germany ..... 51/366
667766 10/1938 Fed. Rep. of Germany .
61-7893 11/1986 Japan ..... B24D 13/20

*Primary Examiner*—Roscoe V. Parker
*Attorney, Agent, or Firm*—Gary L. Griswold; Walter N. Kirn; Peter L. Olson

[57] ABSTRACT

A split abrasive roll is provided, including cooperative engaging members (3) disposed on both the rotatable shaft (2) of an abrasive machine and the inner surface of the roll member. The cooperative engaging members affix the center portion of the split abrasive roll to the shaft, while preserving a uniform abrasive outer surface. The respective ends (**3*b***) of each of the roll members are also retained, and the split abrasive roll so provided tends to overcome the deficiencies in the split abrasive rolls of the prior art.

7 Claims, 5 Drawing Sheets

SPLIT ABRASIVE ROLL ATTACHMENT SYSTEM

TECHNICAL FIELD

The present invention relates to a system for attaching a split abrasive roll to a rotatable shaft.

BACKGROUND OF THE INVENTION

In many applications, it is desirable to attach an abrasive roll to a rotatable output shaft, so that the abrasive roll may be rotated and contacted with a workpiece to abrade material from the workpiece. The abrasive roll is typically cylindrical, and has a cylindrical central bore through which the shaft is fitted. The outer surface of the cylindrical roll includes an abrasive coating, which may be, for example, a bonded or coated abrasive.

In some instances, the shaft onto which the abrasive roll must be mounted is permanently mounted to a machine at each end of the shaft. That is, the abrasive roll may not be mounted on the shaft, because each end of the shaft is attached to a machine, or is otherwise inaccessible. Furthermore, unitary cylindrical abrasive rolls may be difficult to remove from a shaft, due to friction between the shaft and the roll, contaminants on the shaft, and the like. In these situations, a split abrasive roll is used instead of a unitary abrasive roll.

The split abrasive roll is, in essence, a unitary abrasive roll that has been divided along its length to provide two or more components that cooperatively form a complete abrasive roll. For example, FIG. 1 illustrates an abrasive roll 1 having opposed, semicylindrical abrasive roll members 3 adapted for affixation to a cylindrical, rotatable shaft 2. Abrasive roll members 3 are typically attached to shaft 2 using bolts 4 at each end of the roll members, which bolt passes through shaft 2 at two points, as shown in FIG. 1. Japanese Utility Model Publication No. 61-7893 has discloses a similar method of fixing abrasive roll members to a rotary shaft. The two roll members 3 each include an abrasive outer surface 3*a*, against which a workpiece may be applied when the shaft and abrasive roll are rotated.

Although the method for fixing a split abrasive roll described above is satisfactory for some applications, certain disadvantages are also evident. For example, the centrifugal force exerted on the abrasive roll members during rotation of the shaft tend to cause flexing, or bowing, in the center portion of each roll member. Such bowing is undesirable because the surface finish imparted by a bowed roll member is not uniform. The center portion of the roll member, because it extends to a greater radial distance than either of the ends portions, tends to abrade more material from the workpiece, which may be unacceptable. Furthermore, the flexing of the abrasive roll members tends to produce extra noise, which can be distracting. Although a reduction in the rotational velocity of the abrasive roll may attenuate the effects described above, the productivity of the abrading apparatus is similarly reduced.

One method of reducing or preventing the flexing problem and noise problem described above is to provide a third bolt to affix the center of the abrasive roll members to the shaft, as shown in FIG. 2. A hole 5 may be formed through each roll member and through shaft 2, and a third bolt 4 may be used to affix roll members 3 to shaft 2. This construction prevents the roll members 3 from radially flexing in the center portion thereof, even in response to the centrifugal force applied during rotation. However, other problems may instead result.

The formation of holes 5 through abrasive surfaces 3*a* of each of the roll members 3 may cause the workpiece to be abraded nonuniformly. The holes 5, because they do not present an abrasive surface for contact with the workpiece, result in less abrading in the areas of the workpiece proximate the holes. Furthermore, abraded material may accumulate in holes 5, which may also be unacceptable.

In view of the deficiencies of the prior art, it is desirable to provide a split abrasive roll that can be readily mounted on and removed from a rotatable shaft, reduce or prevent radial flexing of the center portions of the roll members, reduce excess noise production during operation, and provide a uniform surface finish to a workpiece.

SUMMARY OF THE INVENTION

A split abrasive roll is provided for attachment to a rotatable shaft of an abrading machine. The abrasive roll includes at least two abrasive roll members each having an abrasive outer surface and an inner surface. The roll members are adapted to cooperatively form a generally cylindrical split abrasive roll, and the inner surfaces are adapted to form a central shaft receiving portion. The abrasive roll members each having first and second ends. A cooperative engaging member is disposed on the inner surface of each of the at least two roll members between the first and second ends, and on the rotatable shaft in a position corresponding to each of said cooperative engaging members disposed on said roll members. The respective first and second ends of the roll portions are also affixed to the shaft.

Various embodiments of the invention are disclosed, including a split abrasive roll wherein the cooperative engaging member disposed on the shaft comprises an engaging projection, and the cooperative engaging members disposed on the inner surfaces of the respective roll members comprise a receiving portion. Alternatively, the cooperative engaging member disposed on the shaft could comprise a receiving portion, and the cooperative engaging members disposed on the inner surfaces of the respective roll members could comprise an engaging projection.

BRIEF DESCRIPTION OF THE DRAWINGS

The present invention will be more readily understood with reference to the accompanying drawings, wherein like reference numerals refer to like components throughout the several views, and wherein.

DETAILED DESCRIPTION OF THE INVENTION

The split abrasive roll of the present invention generally includes cooperative engaging members disposed on both the rotatable shaft of an abrasive machine and the inner surface of the roll member. The cooperative engaging members affix the center portion of the split abrasive roll to the shaft, while preserving a uniform abrasive outer surface. The split abrasive roll so provided tends to overcome the deficiencies in the split abrasive rolls of the prior art.

Figure 1:
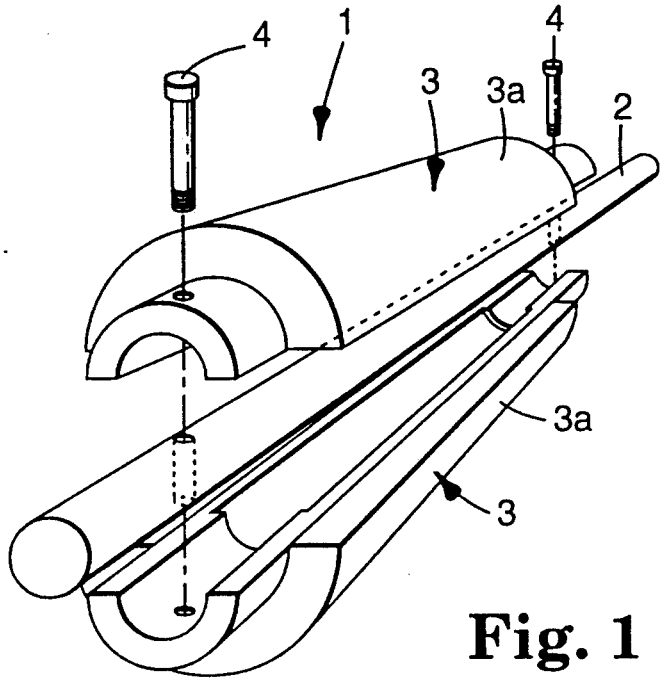
Fig. 1 PRIOR ART
FIG. 1 is a perspective view of a conventional split abrasive roll.
Figure 2:
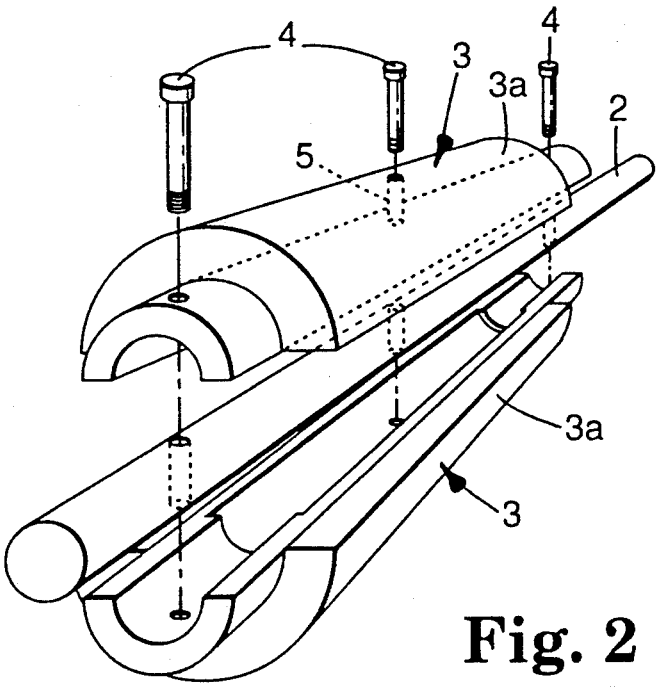
Fig. 2 PRIOR ART
FIG. 2 is a perspective view of a second type of conventional split abrasive roll.
Figure 3:
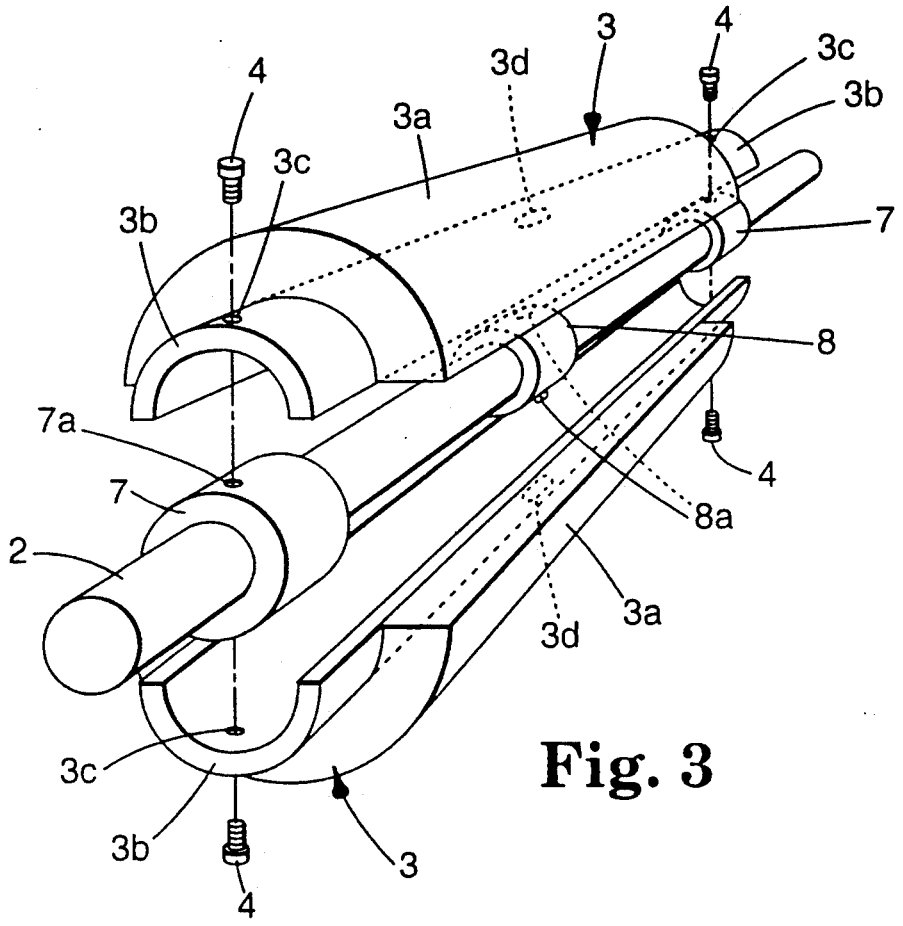
FIG. 3 is an exploded perspective view showing a split abrasive roll according to one embodiment of the present invention.
Figure 4:
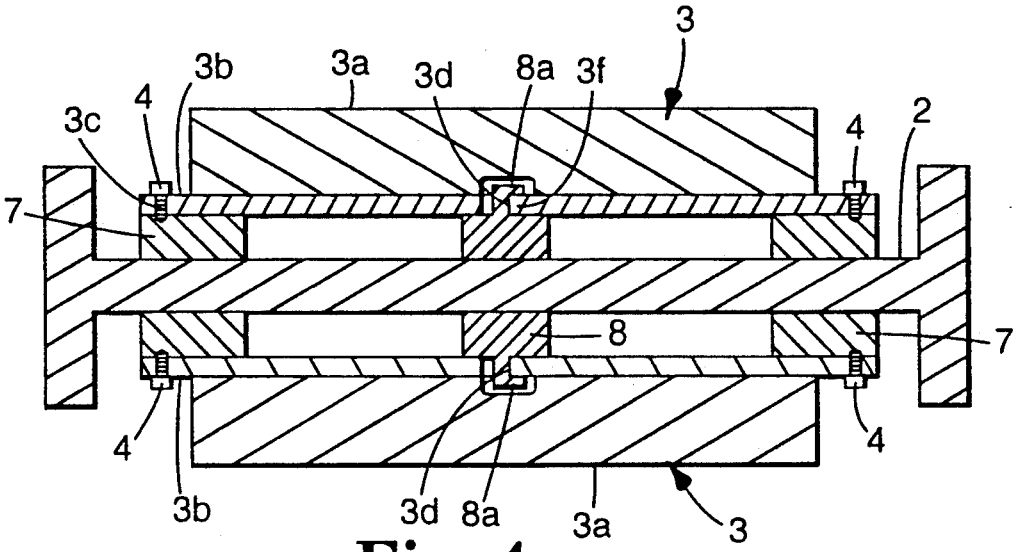
FIG. 4 is a sectional view showing the split abrasive roll illustrated in FIG. 3.

A rotatable output shaft 2 is provided, as shown in FIGS. 3 and 4, which may be powered by an electric or pneumatic motor. Also shown are optional end collars 7 and optional central collar 8, which are mounted on shaft 2. More or less collars 7 and 8 may be provided, if desired. Collars 7 and 8 enable the cooperative engaging members to be formed in the respective collars, rather than in the shaft 2. Alternatively, collars 7 and 8 may be omitted, and the cooperative engaging members formed directly in shaft 2. However, for simplicity, the invention will be described primarily in the context of a shaft having a central collar 8 and two opposed end collars 7, although it should be understood that collars 7 and 8 may be eliminated and the shaft 2 modified accordingly. Collars 7 and 8 may be positioned at any desired locations, but it is preferred that the collars be evenly spaced along the length of the shaft beneath the abrasive roll members to provide support for the split abrasive roll. The collars may be made of any desired material, and are preferably constructed of stainless steel, to enhance wear resistance.

The split abrasive roll includes two or more roll members 3 that are adapted to cooperatively form the abrasive roll when properly affixed to the rotatable shaft 2. In the embodiment illustrated in FIGS. 3 and 4, each roll member 3 is semicylindrical and forms one half of a hollow cylinder, such that the two roll members together provide a cylindrical split abrasive roll when mounted on shaft 2. The illustrated embodiments include two semicylindrical roll members 3, but the present invention is also believed to have applicability to split abrasive rolls having three or more roll members.

The roll members each include an abrasive outer surface 3*a*, and may also include first and second end portions 3*b* that have no abrasive, but are adapted for affixation to shaft 2 as described below. The abrasive portion 3*a* may comprise abrasive particles, such as silicon carbide or alumina particles, bonded to a base material, such as a nylon nonwoven cloth, by a binder such as phenolic resin. Other abrasive surfaces are well known in the art, and may be adapted for use with the split abrasive roll of the present invention.

A feature of the present invention is the means for affixing the central portion of the abrasive roll members to rotatable shaft 2. Different embodiments of the affixation means are contemplated, and each embodiment includes cooperative engaging members on the inner surface of roll members and on the central collar. It should also be noted that with appropriate modifications, cooperative engaging members could be formed on less than all of the roll members, although the following description relates to cooperative engaging members disposed on each of the roll members comprising the split abrasive roll.

A preferred embodiment of the cooperative engaging members for affixing the roll members to the shaft is shown in FIGS. 3, 4, and 5A through 5D. A projecting portion 8*a* is disposed on the outer surface of collar 8, and opposes receiving portion 3*d*, which is disposed in the inner surface of roll member 3. Projecting portion 8*a* and receiving portion 3*d* may thus be cooperatively interengaged to affix the central portion of the roll member 3 to shaft 2. Projecting portion 8*a* could instead be disposed on the inner surface of roll member 3, and receiving portion 3*d* disposed on collar 8, with similar effect. The profile of the projecting portion 8*a* may be matched to the profile of the receiving portion 3*d* to facilitate reciprocal interengagement of the respective cooperative engaging members.

As shown particularly in FIGS. 5A through 5D, projecting portion 8*a* extends from central collar 8 for a first distance, and then extends parallel to shaft 2 for a second distance. It may also be desirable to provide an inclined contact surface on the surface of projecting portion 8*a* that contacts engaging edge 3*f*, to facilitate interengagement of the respective components.

Figure 6:
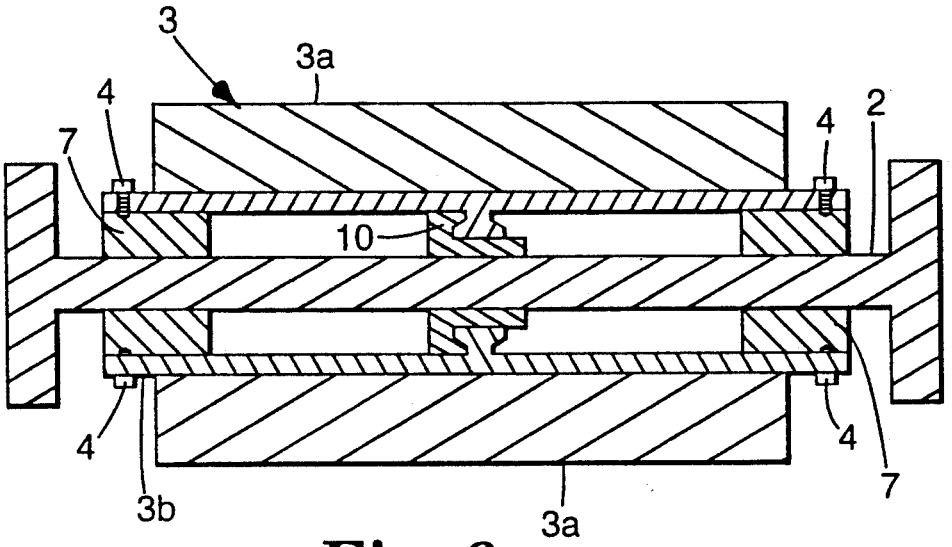
FIG. 6 is a sectional view of a split abrasive roll according to another embodiment of the present invention.
Figure 7A:
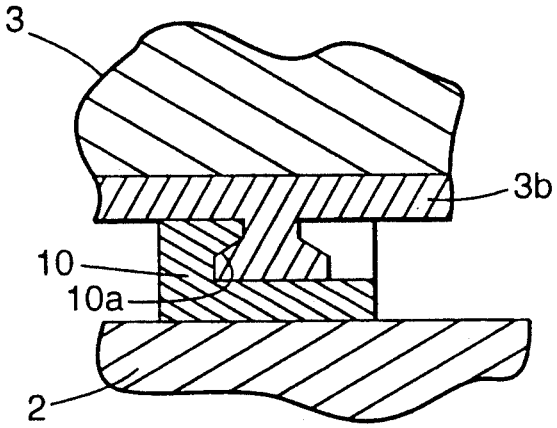
FIG. 7A is an enlarged sectional view of another embodiment of the cooperative engaging members of the present invention.
Figure 7B:
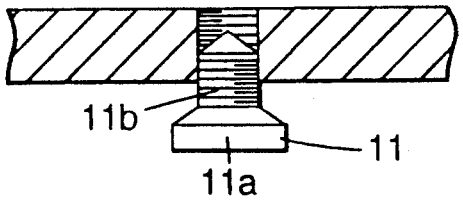
FIG. 7B is an enlarged sectional view showing an engaging projection in another embodiment of the invention.
Figure 8:
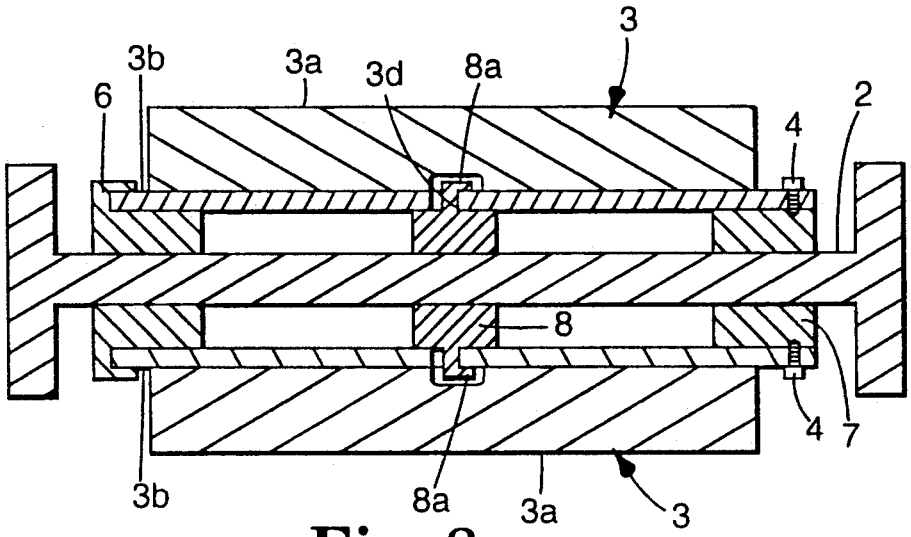
FIG. 8 is a sectional view showing a split abrasive roll according to another embodiment of the present invention.

Other embodiments of the cooperative engaging members are also contemplated. For example, as shown in FIGS. 6, 7A and 7B, the cooperative engaging member could comprise engaging bolt 11, including head 11*a* and threaded portion 11*b*. Thus, the amount by which engaging bolt 11 protrudes from shaft 2 or collar 8 may be adjusted to suit the particular split abrasive roll being applied. Also, the threaded portion 11*b* may include markings along its length, to enable an operator to determine the degree to which the bolt 11 protrudes from collar 8 upon inspection. Bolt 11 is adapted for engagement with another embodiment of a cooperative engaging member, shown in FIGS. 6 and 7A as retaining ring 10. Retaining ring 10 includes contact surface 10*a*, which is adapted for contact with bolt 11, or another suitable engaging member. One or more retaining rings 10 may be provided instead of or in addition to central collar 8, if desired. An added benefit of annular retaining ring 10 is that ring 10 replaces a plurality of individual engaging members circumferentially spaced about and projecting from central collar 8. The foregoing embodiments are intended to be illustrative rather than limiting, and thus the scope of the present invention should not be limited by the foregoing examples.

Also provided are means for affixing the respective ends of the roll members to end collars 7, or to shaft 2 if end collars 7 are not provided. For simplicity, the end affixing means will be described with reference to a shaft having end collars 7. In the embodiment illustrated in FIGS. 3 and 4, the respective ends of each abrasive roll member 3 are affixed to end collars 7 by bolts 4. Each end collar 7 has a hole 7*a* formed therein for receipt of bolts 4. Bolts 4 pass through holes 3*c* formed in end portions 3*b* of roll members 3, and cooperatively engage holes 7*a* of end collars 7. Bolts 4 thus prevent roll members 3 from moving along the length of shaft 2, and thus enable the cooperative engaging members to remain engaged and to affix the central portion of the roll members to the shaft.

Figure 9A:
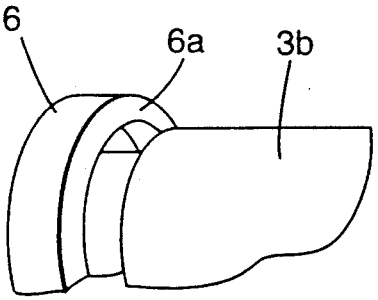
FIGS. 9A through 9E illustrate an end portion of an abrasive roll member being engaged with a retaining flange.
Figure 9C:
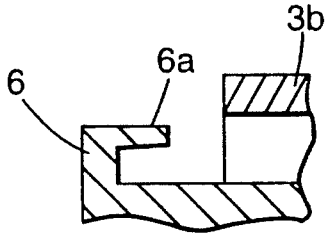
Figure 9B:
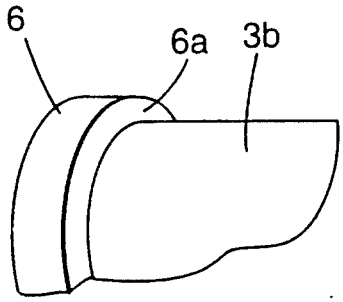
Figure 9D:
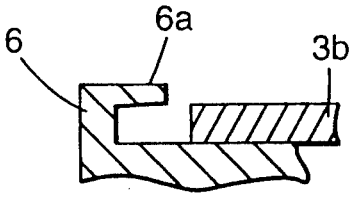
Figure 9E:
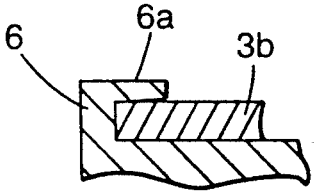

In another embodiment, the end affixing means includes a flange portion 6*a* extending from retaining collar 6, as shown in FIGS. 8 and 9A through 9E. Retaining collar 6 may be annular as shown, and includes a channel portion of sufficient width to enable end edge 3*b* of roll member 3 to be slidingly inserted therein, as shown in FIGS. 9A and 9B, and as shown in cross section in FIGS. 9C, 9D, and 9E. Flange portion 6*a* thus retains at least one end of each roll member 3, and the other end of each roll member 3 may be retained by bolt 4 and end collar 7, as previously described. Other end affixing means are contemplated, and may be selected as known in the art.

Having described the various components of the present split abrasive roll, the assembly of such a roll will now be described. The collars, if provided, are placed on the rotatable shaft by sliding the collars over the shaft. Alternatively, each collar could be fastened to the shaft in two or more pieces, if it is not possible to slide a unitary collar over an end of the shaft. As noted previously, collars 7 and 8 are not required, and shaft 2 could be adapted for direct mounting of roll members 3 if desired.

Figure 5A:
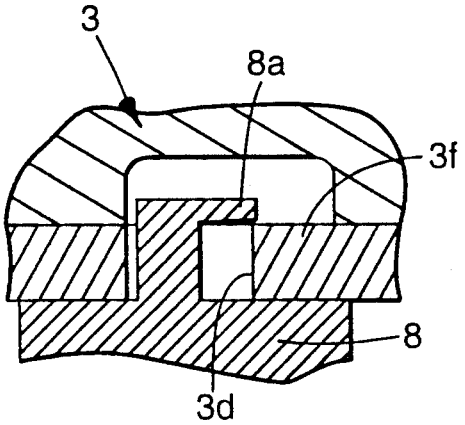
FIGS. 5A through 5D illustrate an enlarged views of one embodiment of cooperative engaging members according to the present invention.
Figure 5B:
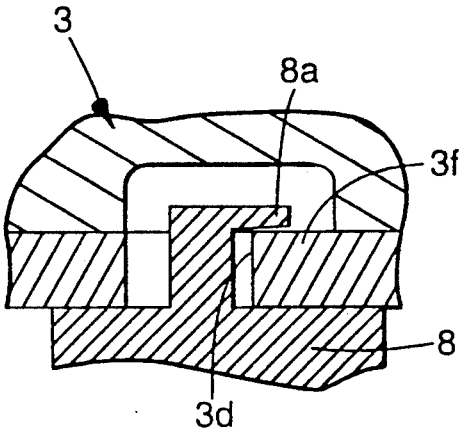
Figure 5C:
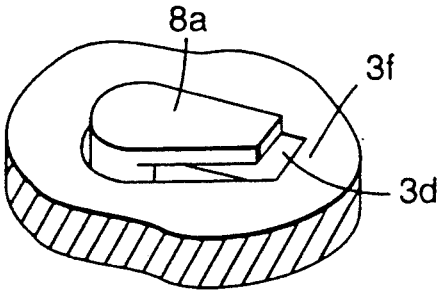
Figure 5D:
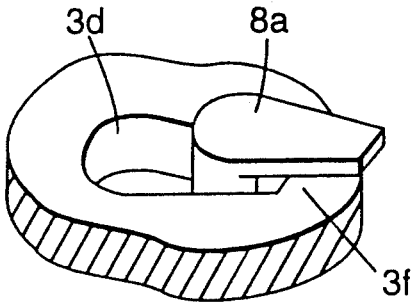

Roll members 3 are place directly adjacent shaft 2, and the cooperative engaging members are situated in opposed relationship to enable interengagement. The cooperative engaging members are then placed together, and are typically engaged by sliding action of the respective components, although other forms of engaging members may require modified assembly procedures. For example, FIGS. 5C and 5D illustrate the engaging projection 8*a* being inserted into receiving portion 3*d* and engaged by moving the respective components in opposite directions to engage the engaging members as shown in FIG. 5D. When the cooperative engaging members have been interengaged, the ends of each roll member may be affixed to the shaft as described previously. That is, each end may be bolted or screwed to the shaft, or one end may be retained by a retaining flange and the other bolted to the shaft, for example.

The present invention has been described herein with reference to several different embodiments. It will be apparent to those skilled in the art that many changes can be made in the embodiments described without departing from the scope of the invention. For example, more than one cooperative engaging member may be disposed on the inner surface of each roll member. Alternatively, cooperative engaging members could be formed on the inner surfaces of less than all the roll members. The split abrasive roll of the invention could also be made by dividing a unitary abrasive roll into roll members of different shapes. Thus, the scope of the present invention should not be limited to the structures described herein, but only by the structures described by the language of the claims and the equivalents of those structures.

We claim:

1. A split abrasive roll for attachment to a rotatable shaft (2), comprising:

(a) at least two abrasive roll members (3) each having an abrasive outer surface (3*a*) and an inner surface, wherein the roll members are adapted to cooperatively form a generally cylindrical split abrasive roll, and said inner surfaces are adapted to form a central shaft receiving portion, said abrasive roll members each having first and second ends (3*b*);

(b) a cooperative engaging member disposed on the inner surface of each of said at least two roll members between said first and second ends;

(c) a cooperative engaging member disposed on the rotatable shaft corresponding to each of said cooperative engaging members disposed on said roll members; and (d) means for affixing the respective first and second ends of the roll portions to the shaft;

whereby said cooperative engaging members are adapted for reciprocal interengagement to affix a central portion of each of said roll members to the shaft, and said end affixing means are adapted to affix said roll members to the rotatable shaft.

2. The split abrasive roll of claim 1, wherein the cooperative engaging member disposed on the shaft comprises an engaging projection (8*a*), and the cooperative engaging members disposed on the inner surfaces of the respective roll members comprise a receiving portion (3*d*).

3. The split abrasive roll of claim 1, wherein the cooperative engaging member disposed on the shaft comprises a receiving portion (3*d*), and the cooperative engaging members disposed on the inner surfaces of the respective roll members comprise an engaging projection (8*a*).

4. The split abrasive roll of claim 1, wherein said at least two abrasive roll members comprise two semicylindrical roll members (3).

5. The split abrasive roll of claim 1, wherein said end affixing means comprises a retaining collar (6) affixed to the rotatable shaft (2) about the circumference of the shaft, said retaining collar including a flange portion (6*a*) adapted to receive and retain said end (3*b*) of each abrasive roll member.

6. The split abrasive roll of claim 1, wherein the first end (3*b*) of each roll member is affixed to the rotatable shaft (2) with a bolt (11), and the second end (3*b*) of each roll member is affixed to the rotatable shaft by a retaining collar (6) having a flange portion (6*a*) adapted to receive and retain said second ends.

7. The split abrasive roll of claim 1, wherein one of said cooperative engaging members comprises a bolt (11) adapted for rotationally adjusting the distance by which said bolt protrudes from a surface.

* * * * *